US006899408B2

(12) United States Patent
Chen et al.

(10) Patent No.: US 6,899,408 B2
(45) Date of Patent: May 31, 2005

(54) TRACK DEVICE FOR A DRAWER

(75) Inventors: Ken-Ching Chen, Kaohsiung Hsien (TW); Shih-Long Hwang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/413,310

(22) Filed: Apr. 15, 2003

(65) Prior Publication Data

US 2004/0207300 A1 Oct. 21, 2004

(51) Int. Cl.[7] ..... A47B 88/00

(52) U.S. Cl. ..... 312/334.44; 312/334.17; 312/334.11; 312/334.47; 312/333

(58) Field of Search ..... 312/333, 334.1, 312/334.44, 334.46, 334.11, 334.17, 330.1, 334.7, 334.8, 334.9, 334.35, 334.47

(56) References Cited

U.S. PATENT DOCUMENTS 5,577,821 A * 11/1996 Chu ..... 312/334.11
6,220,683 B1 * 4/2001 Chu ..... 312/334.44
6,367,899 B1 * 4/2002 Hwang et al. ..... 312/334.47
6,450,600 B1 * 9/2002 Chen et al. ..... 312/334.46
2002/0175605 A1 * 11/2002 Chen et al. ..... 312/333

* cited by examiner

*Primary Examiner*—Peter M. Cuomo
*Assistant Examiner*—Sarah C. Burnham
(74) *Attorney, Agent, or Firm*—Bacon & Thomas

(57) ABSTRACT

A track device includes an outer track having two stops, a middle track slidably mounted in the outer track, the middle track having two slots that provide a passage to the outer track, and an inner track slidably mounted in the middle track. A resilient member includes an engaging portion securely mounted to the middle track and two legs respectively extending through the slots of the middle track. Each leg has an engaging section. When the middle track and the inner track are pulled outward to an extent that the middle track is pulled outward to a predetermined position, the engaging sections of the legs respectively abut against the stops of the outer track to thereby prevent inward movement of the middle track.

10 Claims, 7 Drawing Sheets

TRACK DEVICE FOR A DRAWER

BACKGROUND OF THE INVENTION

1. Field of the Invention

The present invention relates to a track device for a drawer in which movement of a middle track of the track device is prevented during use of the drawer.

2. Description of Related Art

FIG. 1 of the drawings illustrates a so-called "three-part" conventional track device for a drawer. The track device includes an outer track 10, a middle track 20, and an inner track 30. A slide-aiding member 40 is mounted between the middle track 20 and the inner track 30 to allow easy sliding movement of the inner track 30 in the middle track 20. In order to allow easy assembly, the inner track 30 has a retaining member 301 in an inner side thereof and the middle track 20 has a stop 201 on a front end thereof. When the inner track 30 is pulled outward, a protrusion 202 on the stop 201 of the middle track 20 abuts against a protrusion 302 on the retaining member 301, preventing disengagement of the inner track 30 from the middle track 20.

However, when a user is intended to pull both the middle track 20 and the inner track 30 outward for using, e.g., a keyboard in the drawer or for maintaining a device in the drawer, the middle track 20 cannot be retained in place relative to the outer track 10; namely, the middle track 20 is apt to slide either inward or outward relative to the outer track 10.

OBJECTS OF THE INVENTION

An object of the present invention is to provide a track device for a drawer, wherein a resilient member is mounted to a middle track of the track device to prevent the middle track from moving inward during use of the drawer.

Another object of the present invention is to provide a track device for a drawer, wherein the middle track includes an outwardly projecting portion on an inner end of each of two lateral sides thereof, and the outer track includes an inwardly projecting portion on an outer end of each of two lateral sides thereof. A slide-aiding member is mounted between the middle track and the outer track for providing smooth sliding movement of the middle track. Each outwardly projecting portion of the middle track abuts against the slide-aiding member and the respective inwardly projecting portion of the outer track, preventing the middle track from moving outward during use of the drawer.

SUMMARY OF THE INVENTION

The present invention provides a track device comprising an outer track having two stops, a middle track slidably mounted in the outer track, the middle track having two slots that provide a passage to the outer track, and an inner track slidably mounted in the middle track. A resilient member includes an engaging portion securely mounted to the middle track and two legs respectively extending through the slots of the middle track. Each leg has an engaging section.

When the middle track and the inner track are pulled outward to an extent that the middle track is pulled outward to a predetermined position, the engaging sections of the legs respectively abut against the stops of the outer track to thereby prevent inward movement of the middle track.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
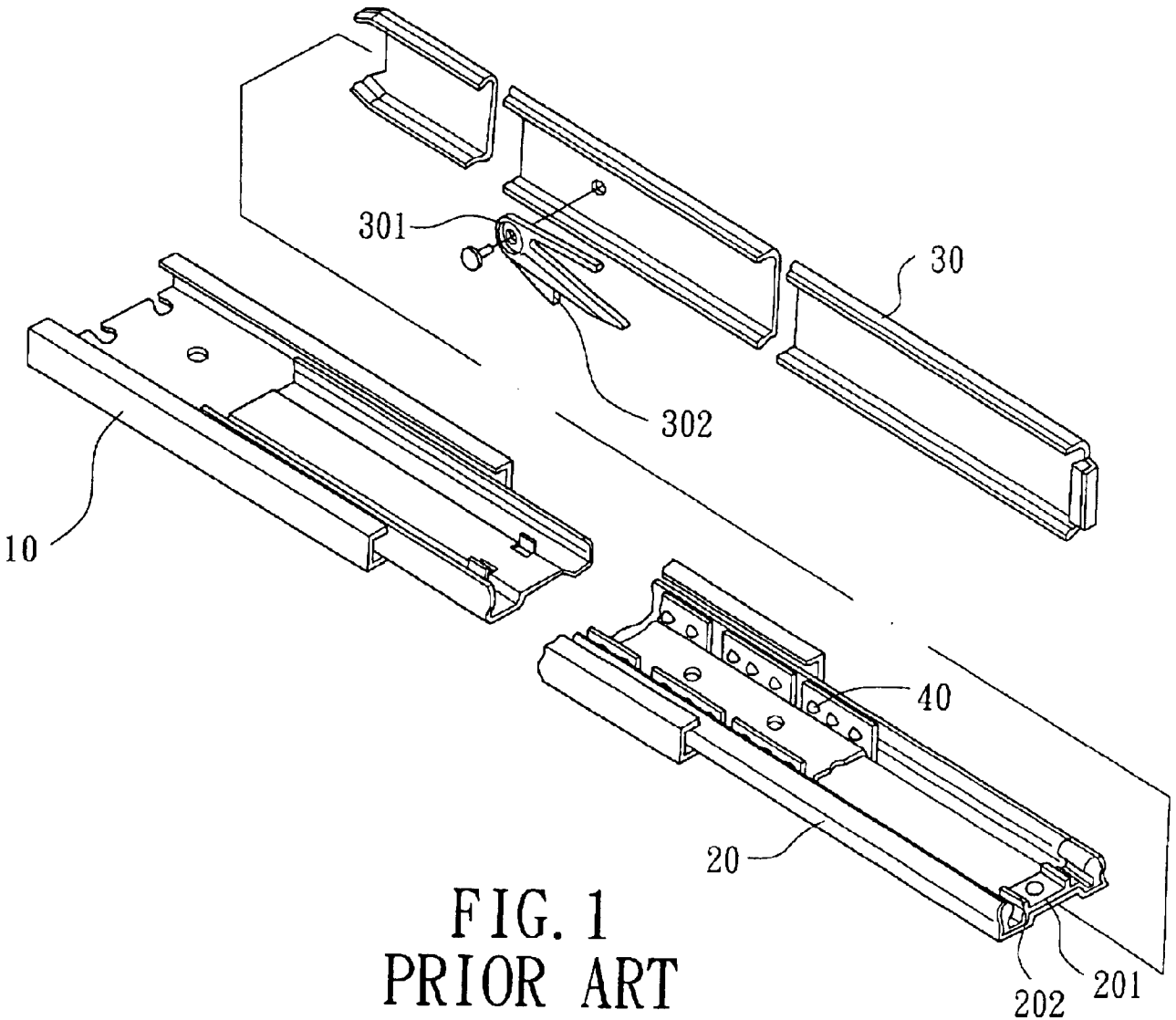
FIG. 1 PRIOR ART
FIG. 1 is an exploded perspective view of a conventional track device.

The present invention is now to be described hereinafter in detail, in which the same reference numerals are used for the same parts as those in the prior art.

Figure 2:
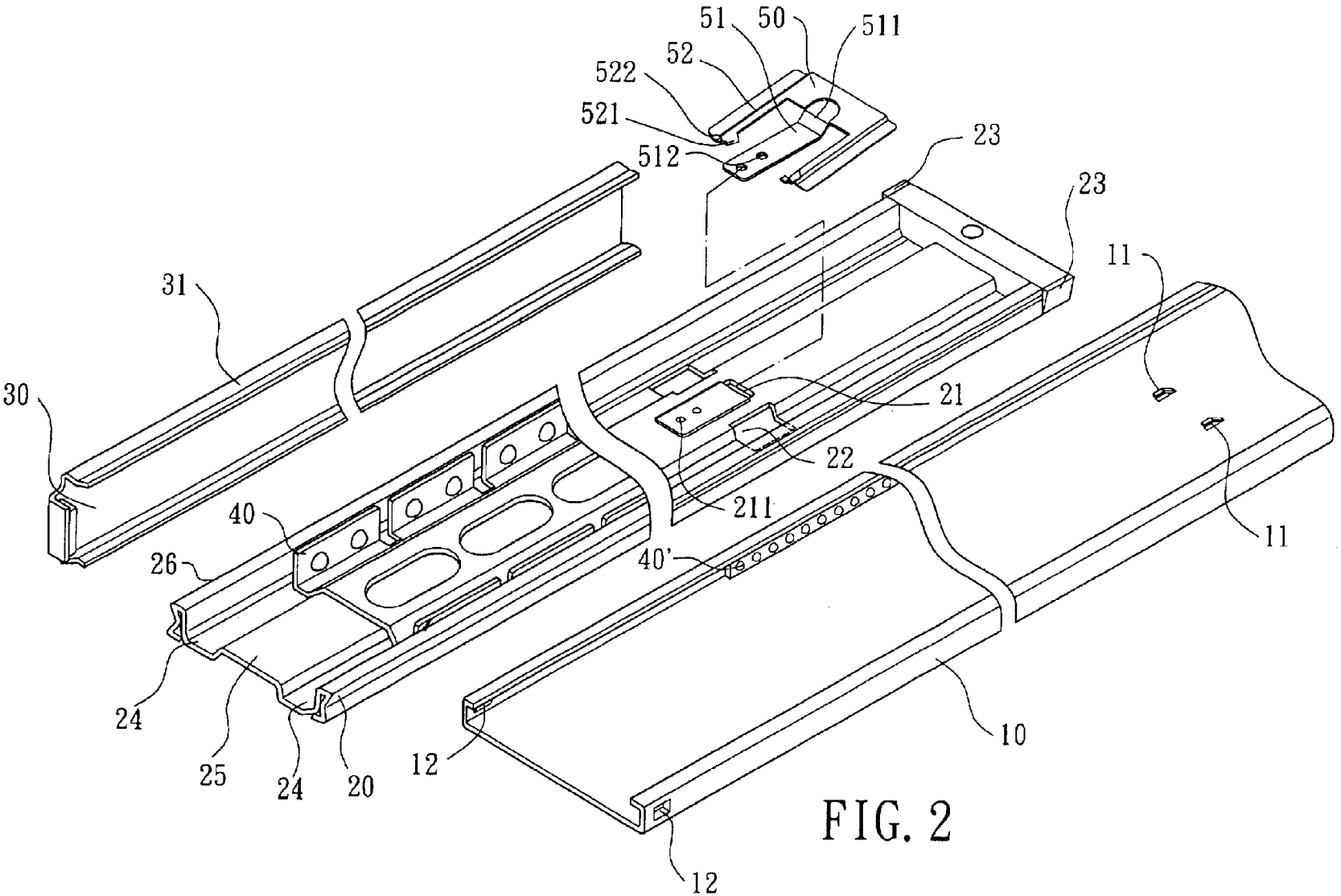
FIG. 2 is an exploded perspective view of a track device in accordance with the present invention.

Referring to FIG. 2, a first embodiment of a track device in accordance with the present invention includes an outer track 10, a middle track 20 slidably received in the outer track 10, and an inner track 30 slidably received in the middle track 20. A slide-aiding member 40 is mounted between the inner track 30 and the middle track 20, allowing smooth sliding movement of the inner track 30. Another slide-aiding member 40' is mounted between the middle track 20 and the outer track 10, allowing smooth sliding movement of the middle track 20. The outer track 10 has two stops 11 on an inner side thereof.

Figure 3:
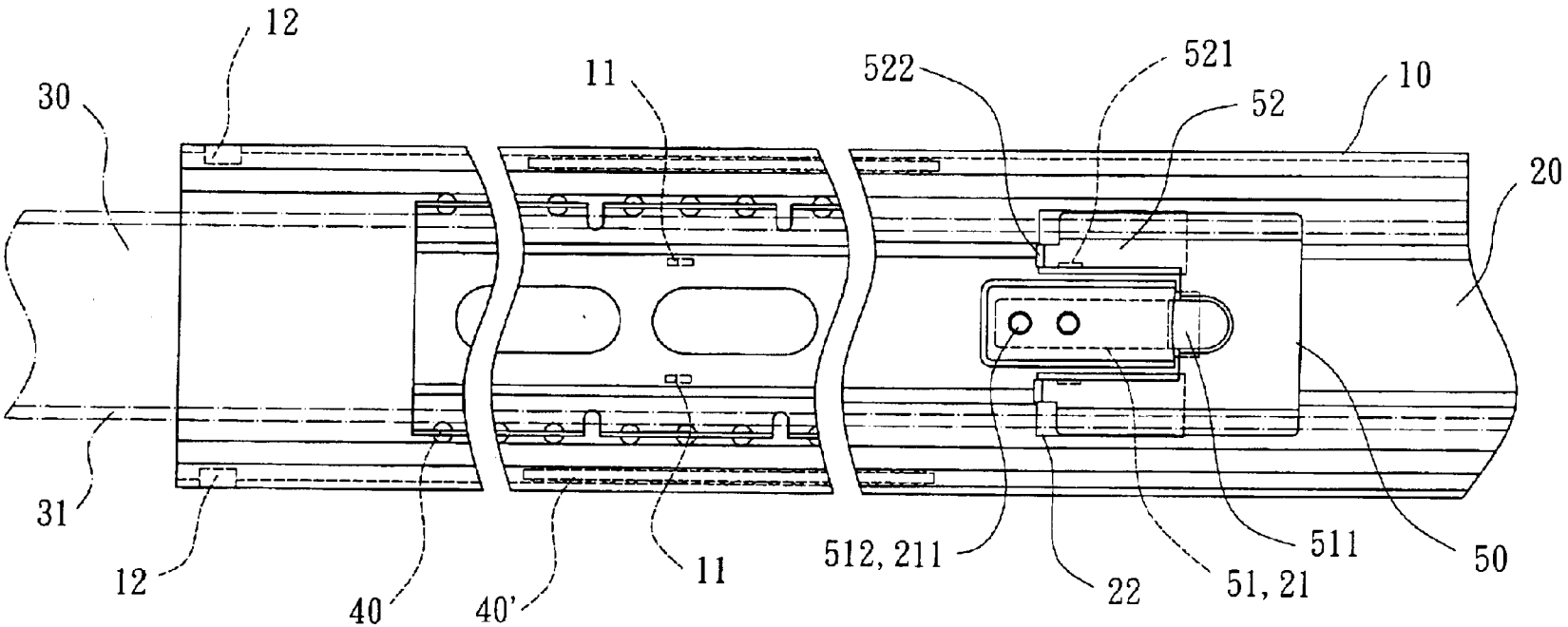
FIG. 3 is a plan view of the track device in accordance with the present invention.
Figure 5:
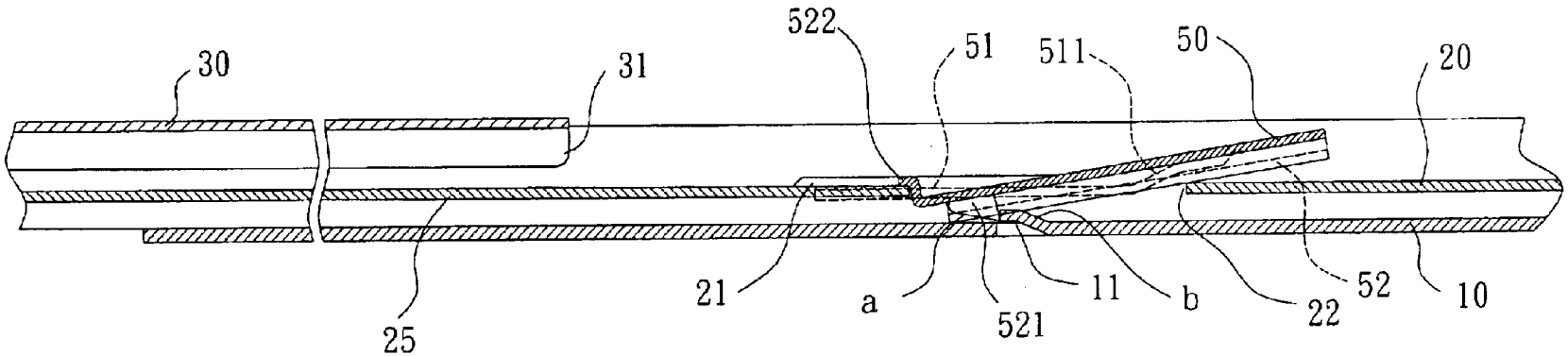
FIG. 5 is a sectional view taken along plane 5—5 in FIG. 4.
Figure 6:
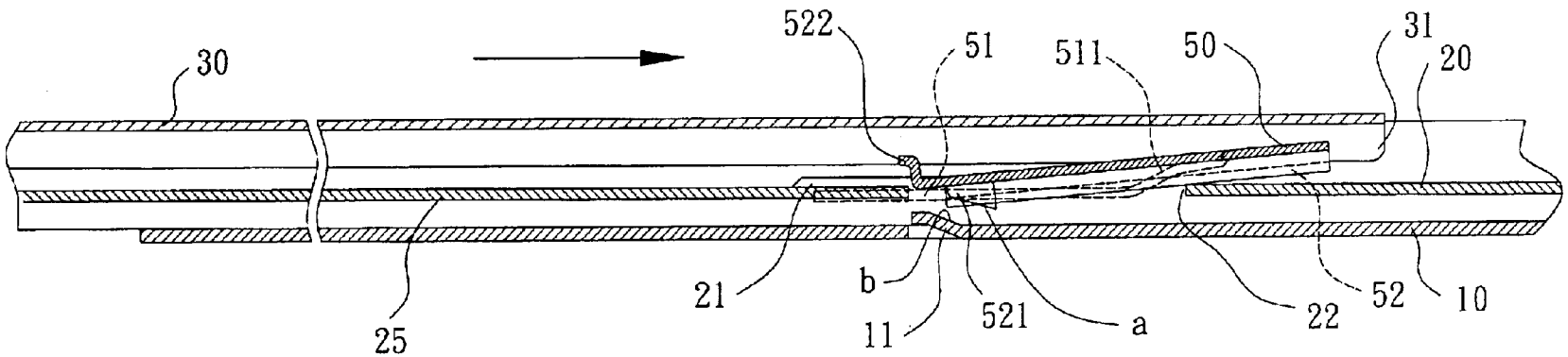
FIG. 6 is a sectional view similar to FIG. 5, wherein an inner track and the middle track are moved inward into an outer track.

The middle track 20 is substantially U-shaped and includes an intermediate portion 25 and two lateral walls 26, with two slots 22 respectively defined in two lateral sides 24 of an intermediate portion 25 thereof. The slots 22 provide a passage to the outer track 10. A resilient member 50 is securely attached to the intermediate portion 25 of the middle track 20. In this embodiment, the intermediate portion 25 includes a slot 21 and two protrusions 211. The resilient member 50 is preferably made of a flexible material such as stainless steel and alloy. The resilient member 50 includes an engaging portion 51 having two holes 512 respectively, securely engaged with the protrusions 211 of the middle track 20. Preferably, the engaging portion 51 has a bending portion 511, forming an ascending inclined bend relative to the intermediate portion of the middle track 25, as shown in FIG. 5. The resilient member 50 is pressed by the inner track 30 toward the intermediate portion 25 of the middle track 20 when the inner track 30 is pushed inward and thus deformed, as shown in FIG. 6. And the resilient member 50 returns to its initial position shown in FIG. 5 when the pressing force is released. Further, the resilient member 50 has two legs 52 respectively extending from two ends thereof. A distal end of each leg 52 has a stop 521 (an engaging section) extending toward the outer track 10. Further, the distal end of each leg 52 has a lug 522 extending from the outer track 10. When the engaging portion 51 of the resilient member 50 is fixed to the intermediate portion 25 of the middle track 20, the legs 52 respectively extend through the slots 22 of the middle track 20, with the stops 521 of the legs 52 extending into the outer track 10 for engaging with the stops 11 of the outer track 10 when the middle track 20 is pulled outward to a predetermined position. Further, each lug 522 of the resilient member 50 abuts against an edge delimiting an associated slot 22 of the middle track 20 to prevent overbending of the legs 52, as shown in FIG. 5. Thus, the legs 52 would not be in frictional engagement with the outer track 10 when the middle track 20 is moved, as shown in FIG. 3.

The resilient member 50, the slots 21 and 22, and the stops 11 are preferably formed by means of punching. The resilient member 50 may be securely fixed to the intermediate portion 25 of the middle track 20 by welding or bonding to increase the bonding strength between the slot 21 of the middle track 20 and the engaging portion 51 of the resilient member 50. Alternatively, the slot 21 can be omitted, and the engaging portion 51 can be directly welded to the intermediate portion 25 of the middle track 20.

Figure 4:
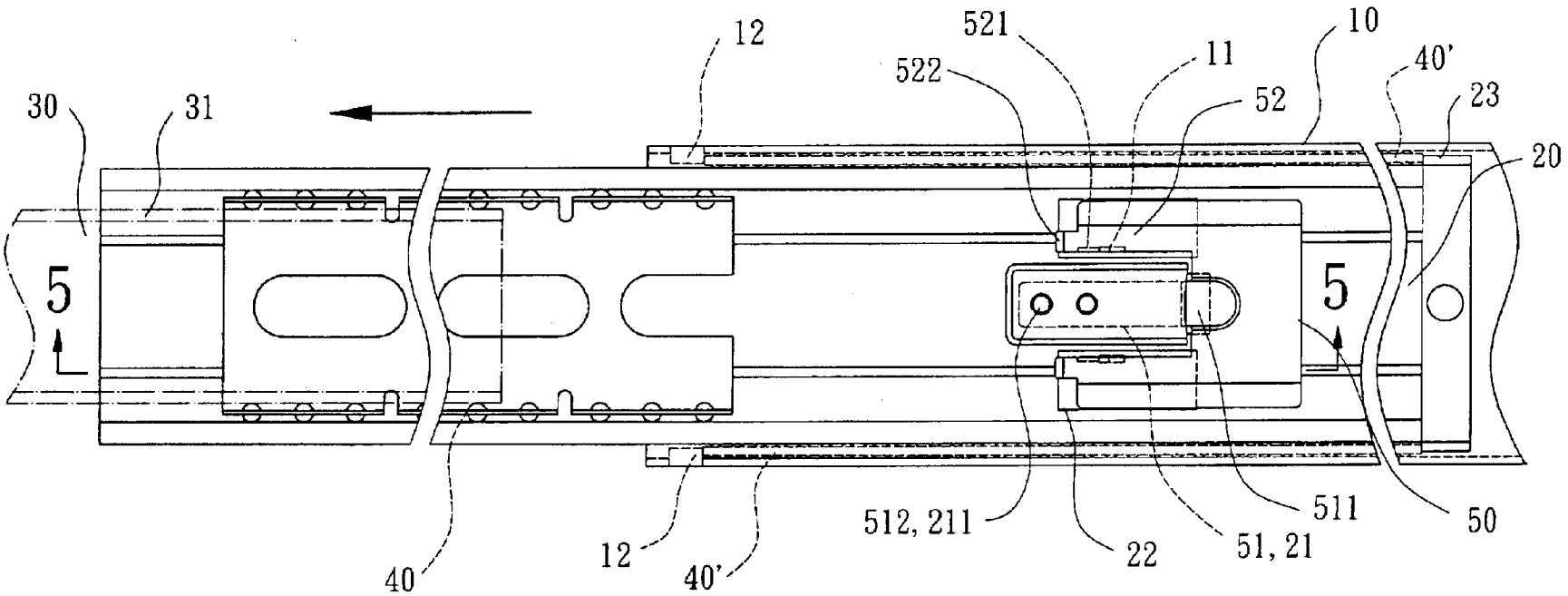
FIG. 4 is a view similar to FIG. 3, wherein a middle track is pulled outward to a predetermined position.

Referring to FIGS. 4 and 5, when the middle track 20 and the inner track 30 are pulled outward to an extent that the middle track 20 is moved to a predetermined position, each stop 521 of the resilient member 50 moves across an associated stop 11 of the outer track 10 and then descends toward the outer track 10. The stops 11 avoid inward movement of the middle track 20 into the outer track 10, which provides convenience while using a keyboard in the drawer or maintaining a device received in the drawer. In order to provide smooth sliding movement of the stop 521 of the resilient member 50 across the respective stop 11 of the outer track 10, the stop 521 has an inclined face "a" and the stop 11 has an inclined face "b", best shown in FIG. 6.

Referring to FIG. 6, when the user is intended to push the middle track 20 inward, the inner track 30 is pushed inward such that each of two lateral walls 31 (acting as a press portion) of the inner track 30 presses the respective leg 52 of the resilient member 50 toward the intermediate portion 25 of the middle track 20. The respective stop 521 of the resilient member 50 is moved away from the intermediate portion 25 of the middle track 20 to a level allowing the respective stop 521 of the resilient member 50 to move across the respective stop 11 of the outer track 10 while pushing the middle track 20 into the outer track 10. Thus, the middle track 20 can not be pushed inward into the outer track 10.

When the middle track 20 and the inner track 30 are pulled outward again, the resilient member 50 returns to its initial position shown in FIG. 5, which provides a positioning effect for preventing the middle track 20 from moving inward into the outer track 10, as the respective stop 521 of the resilient member 50 is stopped by the respective stop 11 of the outer track 10.

Referring to FIGS. 2 and 4, the middle track 20 may include an outwardly projecting portion 23 on an inner end of each of the lateral walls 26 thereof. Further, the outer track 10 may include an inwardly projecting portion 12 on an outer end of each of two lateral sides thereof, and the length of the slide-aiding member 40' is adjusted. When the middle track 20 is pulled outwards to a predetermined position, the respective outwardly projecting portion 23 of the middle track 20 is stopped by the respective inwardly projecting portion 12 and the slide-aiding member 40'. The middle track 20 is reliably retained in place and can not slide either inwards or outwards.

Figure 7:
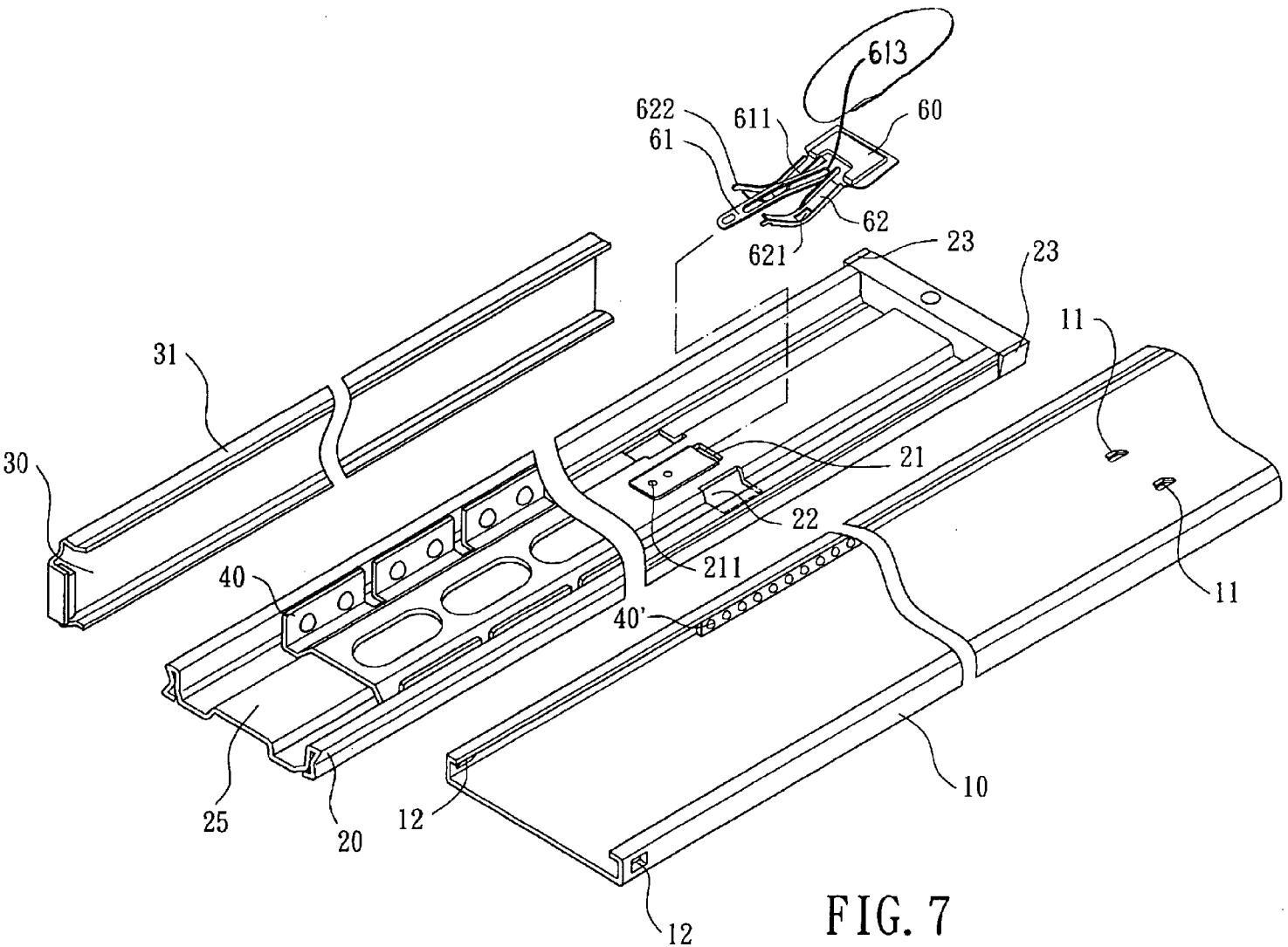
FIG. 7 is an exploded perspective view of a second embodiment of the track device in accordance with the present invention.
Figure 8:
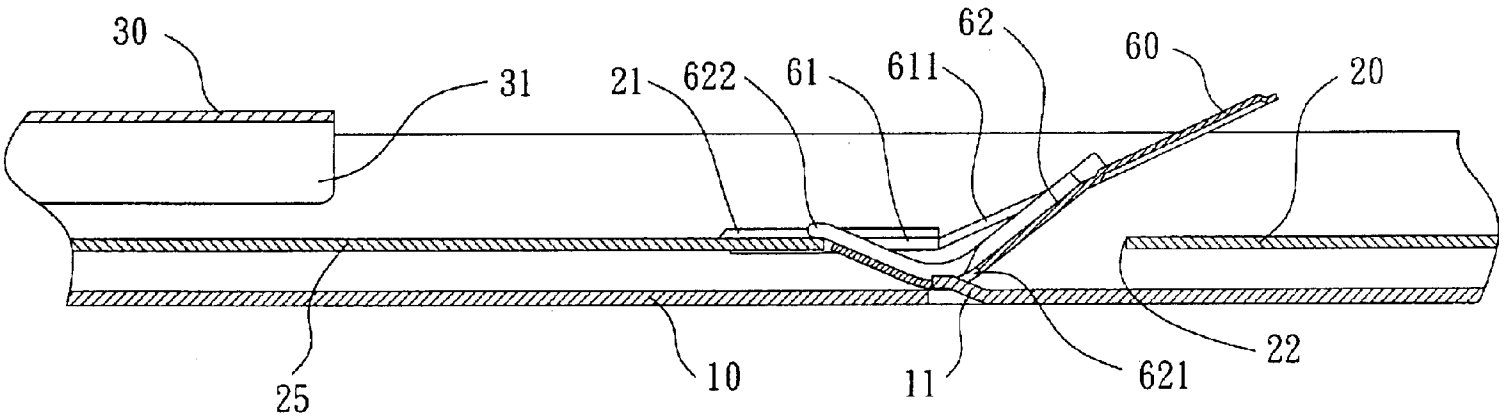
FIG. 8 is a sectional view of the second embodiment of the track device in accordance with the present invention, wherein the middle track is pulled outward to a predetermined position.
Figure 9:
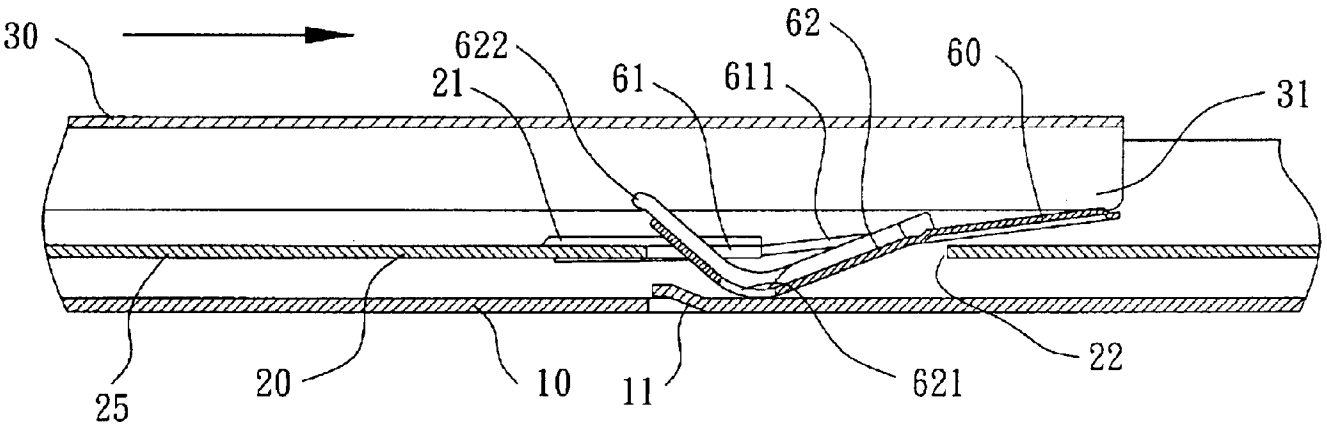
FIG. 9 is a sectional view similar to FIG. 8, wherein the inner track and the middle track are moved inward into the outer track.

FIGS. 7 through 9 illustrates a second embodiment of the resilient member (now designated by 60) of the track device in accordance with the present invention. The resilient member 60 includes an engaging portion 61 with a bending portion 611. The engaging portion 61 of the resilient member 60 further includes an opening 613 to adjust the resilience of the resilient member 60. The bending portion 611 of the resilient member 60 is configured to provide a substantially inverted V-shaped engaging portion 61, forming an ascending inclined bend relative to an intermediate portion of the middle track. The resilient member 60 further includes two legs 62. Each leg 62 is bent to form a substantially V-shaped configuration and has an engaging opening 621 (an engaging section) in an apex of the leg 62. Further, a distal end of each leg 62 has a lug 622.

Referring to FIG. 8, the resilient member 60 is inclined away from the middle track 20. When the middle track 20 is pulled outward to a predetermined position, the respective engaging opening 621 is engaged with the respective stop 11 of the outer track 10 to thereby prevent undesired inward movement of the middle track 20. Further, the respective lug 622 of the resilient member 60 abuts against an edge delimiting the respective slot 22 of the middle track 20, thereby positioning the middle track 20. When the user is intended to push the middle track 20 inward, the inner track 30 is pushed inward such that each of two lateral walls 31 of the inner track 30 presses the respective leg 62 of the resilient member 60 toward the intermediate portion 25 of the middle track 20. The respective engaging opening 621 of the resilient member 60 is moved away from the intermediate portion 25 of the middle track 20 to a level allowing the respective stop 621 of the resilient member 60 to move across the respective stop 11 of the outer track 10 while pushing the middle track 20 into the outer track 10. Thus, the middle track 20 can now be pushed inward into the outer track 10.

When the middle track 20 and the inner track 30 are pulled outward again, the resilient member 60 returns to its initial position shown in FIG. 8, which provides a positioning effect for preventing the middle track 20 from moving inward into the outer track 10, as an edge delimiting the respective engaging opening 621 of the resilient member 60 is stopped by the respective stop 11 of the outer track 10.

While the principles of this invention have been disclosed in connection with its specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A track device comprising:

an outer track having two stops;

a middle track slidably mounted in said outer track, said middle track having two slots that provide a passage to said outer track;

an inner track slidably mounted in said middle track, said inner track has at least one lateral wall acting as a press portion for releasing operation; and a resilient member including an engaging portion securely mounted to said middle track and two legs respectively extending through said slots of said middle track so that said legs face said outer track, each said leg having an engaging section adapted to engage with a respective one of said stops of said outer track, or disengage from said stop of said outer track by pressing said press portion against said resilient member;

wherein when said middle track and said inner track are pulled outward to an extent that said middle track is pulled outward to a predetermined position, said engaging sections of said legs respectively abut against said stops of said outer track to thereby prevent inward movement of said middle track; alternatively in retracting operation, said press portion of said inner track contacts said resilient member such that said engaging sections of the legs of said resilient member are disengaged from said stops of said outer track to thereby allow inward movement of said middle track.

2. The track device as claimed in claim 1, wherein said engaging section of each said leg includes a stop formed on a distal end of said respective leg and extending toward said outer track, said stop of each said leg having an inclined face, each said stop of said outer track having an inclined face that faces said inclined face of the respective leg.

3. The track device as claimed in claim 1, wherein each said leg of said resilient member is bent to form a substantially V-shaped configuration having an apex, said engaging section of each said leg including an engaging slot defined in said apex of the respective leg.

4. The track device as claimed in claim 1, wherein said engaging portion of said resilient member includes a bending portion forming an ascending inclined bend relative to an intermediate portion of said middle track.

5. The track device as claimed in claim 1, wherein said engaging portion of said resilient member includes a bending portion to provide a substantially inverted V-shaped configuration, forming an ascending inclined bend relative to an intermediate portion of said middle track.

6. The track device as claimed in claim 1, wherein each said leg has a lug an a distal end thereof, each said lug abutting against an edge delimiting an associated one of said slots of said middle track when said middle track is pulled outward to said predetermined position.

7. The track device as claimed in claim 1, wherein said resilient member, said slots of said middle track, and said stops of said outer track are formed by means of punching.

8. The track device as claimed in claim 1, wherein said middle track has a further slot defined in an intermediate portion thereof, said engaging portion of said resilient member abutting against an edge of said further slot, preventing said resilient member from being in frictional contact with said outer track, said intermediate portion having at least one protrusion, said engaging portion of said resilient member having at least one hole for securely engaging with said at least one protrusion of said middle track.

9. The track device as claimed in claim 1, wherein said middle track includes an outwardly projecting portion on an inner end of each of two lateral sides thereof, and wherein said outer track includes an inwardly projecting portion on an outer end of each of two lateral sides thereof, further including a slide-aiding member mounted between said middle track and said outer track for providing smooth sliding movement of said middle track, each of said outwardly projecting portions of said middle track abutting against said slide-aiding member and the respective inwardly projecting portion of said outer track, preventing said middle track from moving outward during use.

10. The track device as claimed in claim 1, wherein said press portion comprises a pair of lateral walls, said lateral walls are used to actuate said legs of said resilient member such that said engaging sections of said resilient member are disengaged from said stop of said outer track.

* * * * *